US008109051B2

(12) United States Patent
Showers

(10) Patent No.: US 8,109,051 B2
(45) Date of Patent: Feb. 7, 2012

(54) INSULATING CORRECTIVE LENS SYSTEM FOR AFTERMARKET WINDOWS

(76) Inventor: Robert James Showers, Seymour, CT (US)

( * ) Notice: Subject to any disclaimer, the term of this patent is extended or adjusted under 35 U.S.C. 154(b) by 21 days.

(21) Appl. No.: 12/761,194

(22) Filed: Apr. 15, 2010

(65) Prior Publication Data

US 2011/0206874 A1 Aug. 25, 2011

Related U.S. Application Data

(60) Provisional application No. 61/307,685, filed on Feb. 24, 2010.

(51) Int. Cl.
*E06B 3/30* (2006.01)

(52) U.S. Cl. ..... 52/204.53; 52/171.3; 52/204.61; 52/306

(58) Field of Classification Search ..... 52/831, 52/836, 846, 843, 466, 467, 202, 203, 204.53, 52/204.61, 456, 306; 428/68, 76; 296/97.1; 160/40, 84.01
See application file for complete search history.

(56) References Cited

U.S. PATENT DOCUMENTS

| | | | | |
|---|---|---|---|---|
| 3,220,065 | A * | 11/1965 | Graham | 49/67 |
| 3,762,118 | A * | 10/1973 | Sanders | 52/171.3 |
| 4,198,796 | A * | 4/1980 | Foster | 52/203 |
| 4,287,683 | A * | 9/1981 | Louwenaar | 49/463 |
| 6,877,286 | B2 * | 4/2005 | Johnson | 52/202 |
| 6,898,914 | B2 * | 5/2005 | Folsom et al. | 52/656.8 |
| 7,641,954 | B2 | 1/2010 | Rouanet et al. | |
| 2007/0122588 | A1 | 5/2007 | Milburn | |

OTHER PUBLICATIONS

U.S. Appl. No. 12/761,182, filed Apr. 15, 2010, Showers.

* cited by examiner

*Primary Examiner* — William Gilbert
*Assistant Examiner* — Gisele Ford
(74) *Attorney, Agent, or Firm* — Ming Chow; Sinorica, LLC

(57) ABSTRACT

An aftermarket application to improve the insulating properties of an existing window using vessels filled with nanotechnology insulating materials. Application does not impede users' ability to see through while minimizing heat transfer allowed through the window. The vessels can be customized by contractors and engineers to control range and direction of vision that viewers from the inside and outside can see.

20 Claims, 10 Drawing Sheets

INSULATING CORRECTIVE LENS SYSTEM FOR AFTERMARKET WINDOWS

The current application claims a priority to the U.S. Provisional Patent application Ser. No. 61/307,685 filed on Feb. 24, 2010.

FIELD OF THE INVENTION

The invention relates generally to vessels which can be adhered to existing windows to enhance its ability to insulate and minimize heat transfer. It is the objective of the present invention to effectively insulate while allowing users to see through the window while managing what direction the viewer is permitted to see in.

BRIEF DESCRIPTION OF THE PRIOR ART

With limited natural resources, energy providers are beginning to charge real estate owners more for their services. To compensate for the increase in energy prices, energy efficient products are constantly being developed. Even methods of building homes and building are changing to become more energy efficient. A direction for contractors to make buildings more energy efficient is to include energy efficient windows. There have been many windows developed that minimize heat transfer by increasing the insulation. Among these are windows developed are insulated glazing units, which include two panes of glass which are separated by a spacer frame. Within the frame and two panes of glass is sealed a gas which increases the R-value and U-factor of the window. This allows for increased insulation and is moderately energy efficient.

The United States Patent Application Publication 2007/0122588 A1 introduces a glazing unit with a honeycombed structure to contain silica Aerogel particles. However, again the aerogel is used to fill all the compartments and reduces the ability of a user to see through the invention.

The U.S. Pat. No. 7,641,954 introduces a panel and glazing system that makes use of thermoplastic panels with internal channels that are able to hold Aerogel compound. The insulated glazing system proposed in this patent makes use of two U-shaped elements to create spacing to bind the thermoplastic panels for insulation. The insulated glazing system instead of using two flat glass panes with spacers and sealants makes use of U-shaped glass elements to seal the insulating panel.

None of the prior art stated above with Aerogel allow a user to see through and does not allow users to have control over what directions they can see through the window and are applied aftermarket vessels. The present invention also is an aftermarket application allowing users to apply the vessels onto existing windows, whereas the prior art are set window systems.

BACKGROUND OF THE INVENTION

Recently, the thermal insulating properties of Aerogel have been uncovered. Aerogel was discovered in 1931 by Samuel Stephen Kistler. Since then, aerogel has constantly been researched and improved upon. Aerogels have now been applied to the window industry to produce highly energy efficient windows. In the place of gases for the insulated glazing unit, Aerogels have been sealed within the window. However, even though Aerogel is translucent, it is not transparent. This property of Aerogel prevents the user from being able to see through a window. Aerogel has also been applied to polycarbonate vessels for daylighting windows. However, this application of Aerogel has still yet to allow users to see through the windows.

The present invention is vessels that seal Aerogel that can be adhered to existing windows to reduce the transfer of heat across the window. The Aerogel filled vessels can be arranged in different patterns according to the user's environment and needs. Aerogel is a translucent material but not transparent, therefore the present invention contains the aerogel in vessels to be arranged in a way where users can still look through a window while give the window an aesthetically pleasing appearance. In addition, these vessels can be customized by contractors or engineers to control the direction the viewers from inside and outside can see through the window system. The ability of the present invention to control the range and direction of vision collectively makes a corrective lens for the window system. The Aerogel also has exceptional insulating properties which will aid the present invention to minimize heat transfer across the window.

DETAIL DESCRIPTIONS OF THE INVENTION

Figure 1:
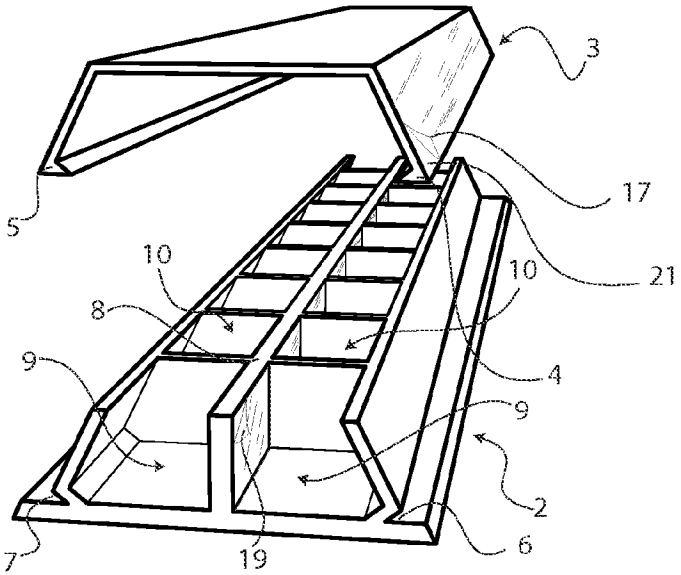
FIG. 1 is a perspective view of the vessel cover and the vessel base separated for an embodiment of the present invention.
Figure 2:
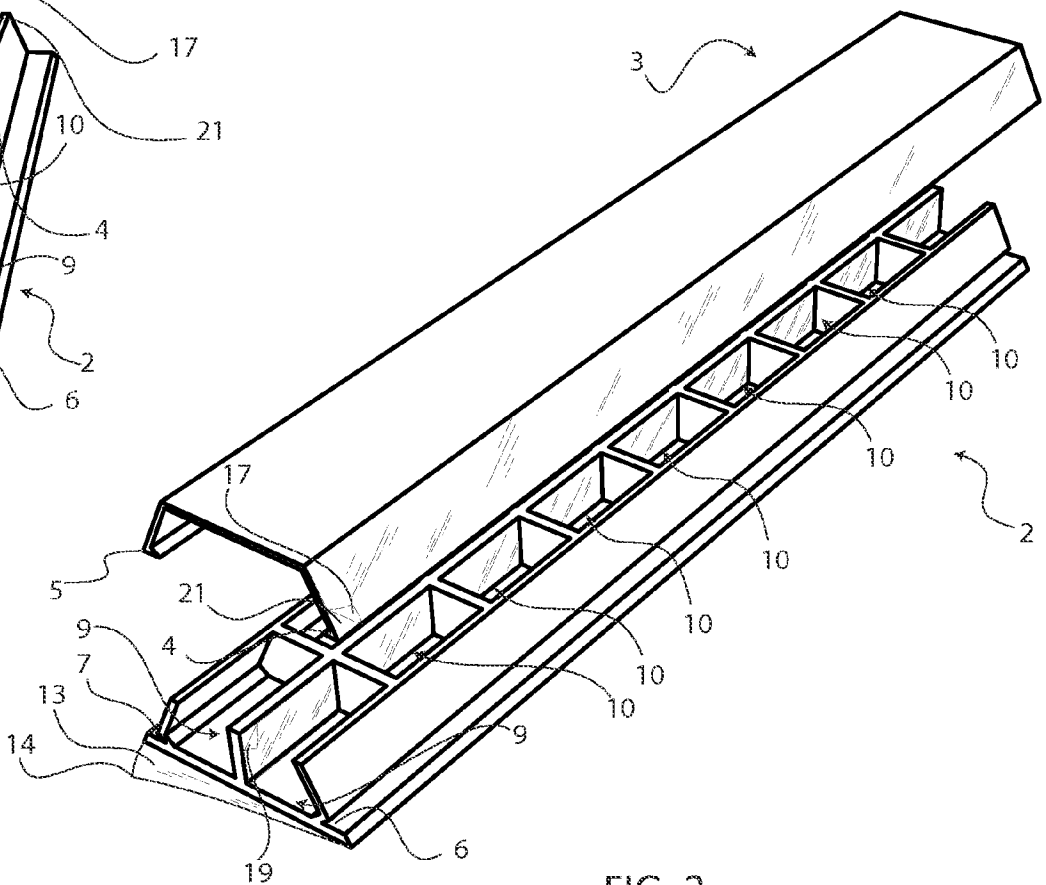
FIG. 2 is a perspective view of the vessel cover and the vessel base separated for an embodiment of the present invention.
Figure 4:
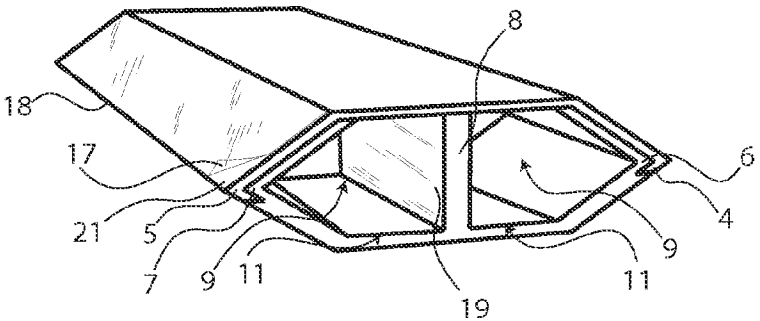
FIG. 4 is a perspective view of the vessel cover engaged to the vessel base of the doubly angled vessel embodiment of the present invention
Figure 3:
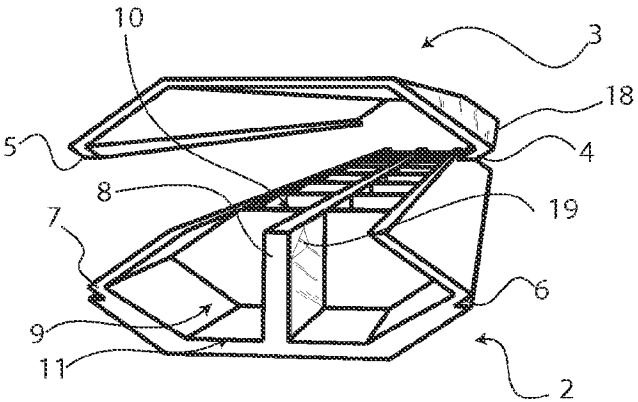
FIG. 3 is a perspective view of the vessel cover and the vessel base of a doubly angled vessel embodiment of the present invention.
Figure 5:
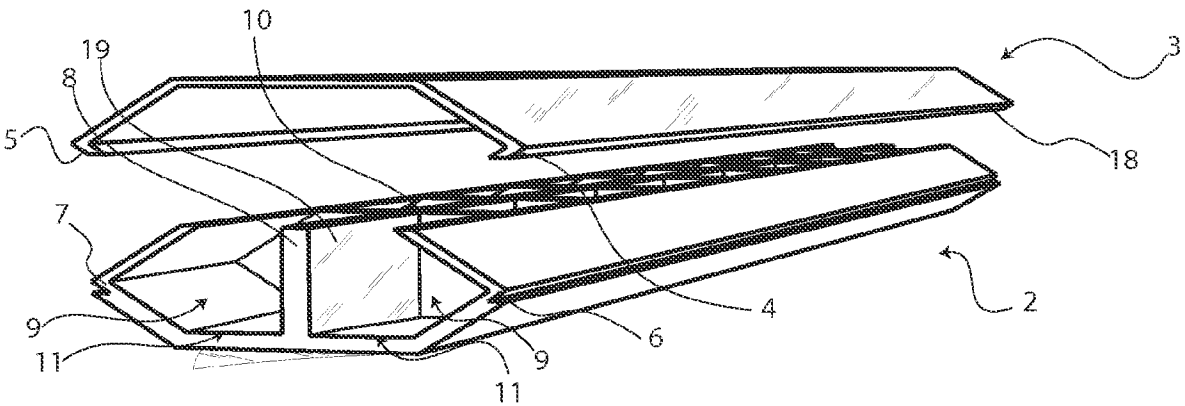
FIG. 5 is a perspective view of the vessel cover and the vessel base of a doubly angled vessel embodiment of the present invention.

All illustrations of the drawings are for the purpose of describing selected versions of the present invention and are not intended to limit the scope of the present invention. Thermal insulating windows have become a product that is able to help families or building significantly save on energy cost. However, there are families that are unable to afford to install completely new windows. The present invention is an after-market window product that will increase the insulation of the existing windows without having to spend time and money on complete replacements.

The present invention is a vessel 1. In reference to FIG. 1, FIG. 3, FIG. 8, FIG. 9, and FIG. 12, the vessel 1 is a construction of a plurality of sub components consisting of a vessel base 2, a vessel cover 3, at least one end opening 11, an insulating substance 12, a vessel adhesive 13, a vessel film 14, at least one strip with at least one end cap 15, an end cap adhesive 16, at least one angled edge adhesive film 17, at least one angled edge 18, at least one angled surface 21 and at least one vent hole 20. The vessel base 2 and the vessel cover 3 together forms the main body of the vessel 1. The vessel base 2 and the vessel cover 3 are made of materials consisting of polycarbonate, glass, or acrylic. The materials for the vessel base 2 and the vessel cover 3 are to be optically clear, translucent or both. The vessel base 2 and the vessel cover 3 are also to be UV stable. Being UV stable will prevent yellowing and UV damage from exposure to the rays of the sun. The vessel base 2 comprises of a first latch receiving edge 6, a second latch receiving edge 7, at least one partition 8, at least one end cavity 9, at least one internal cavity 10, and at least one interior vessel adhesive film 19. The at least one end cavity 9 and at least one internal cavity 10 are formed by the at least one partition 8. The at least one partition 8 act as a walls separating the cavities for the at least one end cavity 9 and at least one internal cavity 10. Along the surfaces of the at least one partition 8 is adhered the at least one interior vessel adhesive film 19. These films are used to help facilitate light through the vessel 1 as well as filter out any harmful rays from the sun. The at least one interior vessel adhesive film 19 is an adhesive film that makes use of pressure sensitive adhesives for adhering to the at least one partition 8. The film of the at least one interior vessel adhesive film 19 can be made of different films depending on environment and user specifications. These films can be Biaxially-oriented polyethylene terephthalate film, reflective film, sputtered film, polyester film, ceramic film, and tinted film. However, the choice of film for the preferred embodiment of the present invention makes use of the Biaxially-oriented polyethylene terephthalate film, also known as Mylar film, due to its ability to reflect thermal radiation.

Once the at least one interior vessel adhesive film 19 has been adhered to the at least one partition 8, the at least one end cavity 9 and at least one internal cavity 10 is filled with the insulating substance 12. The insulating substance 12 can be Aerogel particles, Nanogel particles, Maerogel particles, or other suitable Aerogel technologies that may, in the future be approved upon. All these types of gels are excellent insulators that are silicon matrixes trapping air. These gels are generally a large percentage of air and a very small percentage of actual solid. The large amount of air that this material traps is what makes it a strong insulator. However these gels are not transparent, but rather translucent. Therefore although not allowing users to see through the vessel 1, it will still allow light to traverse through it. The preferred material for the insulating substance 24 is the translucent Cabot Nanogel particles due to its abilities to allow the optimum amount of light through. The second preferred material for the insulating substance 24 is Aerogel and the third is Maerogel. After the cavities of the at least one end cavity 9 and at least one internal cavity 10 have been filled, the vessel cover 3 is engaged to the vessel base 2. The vessel cover 3 engages the vessel base 2 by means of latching. The vessel cover 3 comprises of a first side edge latch 4 and a second side edge latch 5. The first side edge latch 4 and second side edge latch 5 is connected to the first latch receiving edge 6 and second latch receiving edge 7 of the vessel base 2, respectively. Due to the plurality of cavities involved with the vessel base 2, it is to be manufactured using a mold injection method. As for the vessel cover 3, it can be manufactured using a mold injection method or an extrusion method. The engagement of the vessel cover 3 to the vessel base 2 will seal the insulating substance into the at least one internal cavity, however there will still be the at least one end opening leading 11 to the at least one end cavity 9.

In reference to FIG. 8, FIG. 9, FIG. 10, FIG. 11, and FIG. 12, to prevent the insulating substance 12 that has been filled into the at least one end cavity 9 from leaking out, the at least one end opening 11 is to be sealed as well. Sealing of the at least one end opening 11 involves the insertion of the at least one strip with at least one end cap 15. To make sure that the at least one strip with at least one end cap 15 is securely sealed the at least one end opening 11 is the end cap adhesive 16. The end cap adhesive 16 is made from an optically clear and UV stable adhesive selected from the group consisting of silicone resin, gasketing resin, modified acrylated resin, or epoxy resin. The at least one strip with at least one end cap 15 is made from materials consistent to the vessel base 2 and vessel cover 3 including polycarbonate, acrylic, and glass. To ensure that the connection between the at least one strip with at least one end cap 15 to the at least one end opening 11 is as seamless as possible, it is manufactured to match the shape of the vessel cover 3 and vessel base 2 combined. If the choice of material for the vessel 1 is glass, the at least one vent hole 20 will be drilled into the vessel 1 leading the at least one end cavity 9 or the at least one interior cavity 10. This at least one vent 20 will be able to equalize the pressure inside the vessel 1 with the pressure outside to prevent stress from cracking the glass. Polycarbonate vessels will not be made with the at least one vent hole 20.

The vessel 1 is to be manufactured with the at least one angled edge 18. It is positioned on the sides of the vessel 1 where the at least one end openings 11 are not located. This angling will allow users to have a wider range of view through the present invention as well as allow more natural healthy light to enter through at time of the day as shown in FIG. 15, FIG. 16, FIG. 17, and FIG. 18. The additional light that is allowed by the at least one angled edge 18 also reduces any shadowing that may be caused by the vessel 1. With additional light entering a room using the present invention, there is less need for users to use artificial lighting and as a result they will be able to lower their energy bills for lighting. The vessel 1 can be customized with varying angles for the at least one angled edge 18 to fit the environment and situation that the user is under. By having the at least one angled edges, the at least one angled surface 21 is formed. The at least one angled edge adhesive film 17 is adhered to the at least one angled surface 21 of the at least one angled edge 18. The at least one angled edge adhesive film is made of a optically clear film selected from the group consisting of Biaxially-oriented polyethylene terephthalate film, reflective film, sputtered film, polyester film, ceramic film, and tinted film. In the preferred embodiment of the present invention, the at least one angled edge adhesive film 17 is made of Biaxially-oriented polyethylene terephthalate film with a pressure sensitive adhesive, which is able to reflect 90+% radiant heat and will further enhance the insulating properties of the present invention. The at least one angled edge 18 also offers more security to users as it allows users to see out the present invention more easily, but makes it difficult for people on the outside to see into a room using the window system of the present invention.

The vessel 1 is to be applied to existing windows by adhesion. To do so, the vessel 1 makes use of the vessel film 14 and the vessel adhesive 13. The vessel adhesive 13 can be a pressure sensitive adhesive, solvent based adhesive or water activated adhesive. These adhesives can be materials such as epoxy resin, gasketing resin, modified acrylated resin, or silicone resin. It is also important that these adhesives be optically clear and UV stable to ensure that the vessel is lasting on the applied window. The vessel adhesive 13 is applied to both sides of the vessel film 14 and adhered to the vessel 1. The vessel film can be made of optically clear films selected from the group consisting of Biaxially-oriented polyethylene terephthalate film, reflective film, sputtered film, polyester film, ceramic film, and tinted film. With this adhesive film layer, the vessel 1 is ready to apply to an existing window. If the present invention is bought by a user for self application, the vessel 1 can have a factory applied pressure sensitive adhesive or a water activated adhesive. However, if the present invention is being used by a contractor, the applied adhesive can also be a solvent based adhesive that can be applied on the field.

Figure 6:
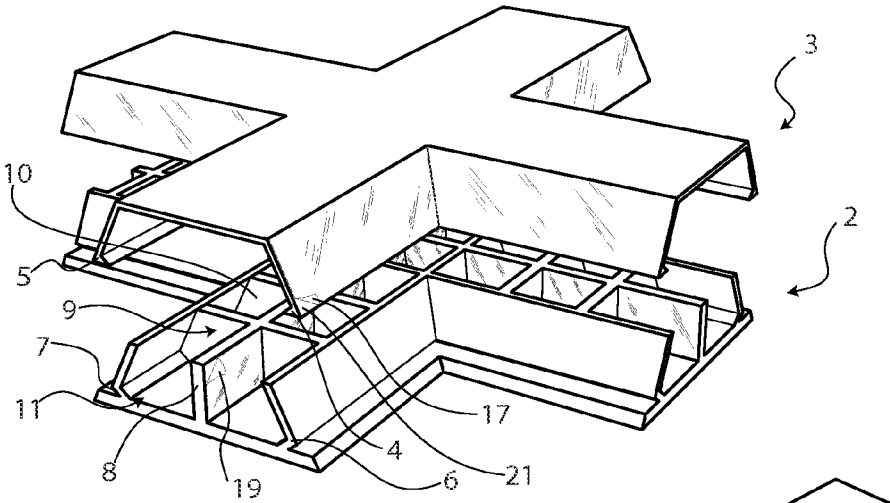
FIG. 6 is a perspective view of cross type embodiment of the present invention with the vessel cover separated from the vessel base.
Figure 7:
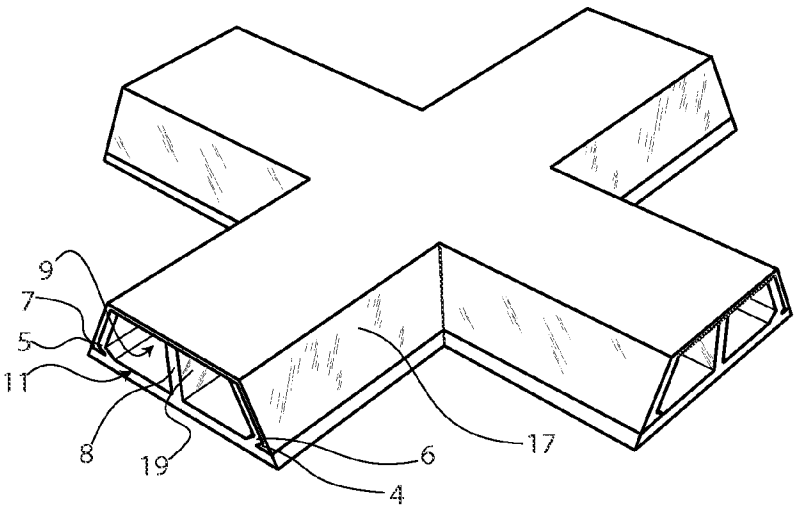
FIG. 7 is a perspective view of cross type embodiment of the present invention with the vessel cover engaged to the vessel base.
Figure 9:
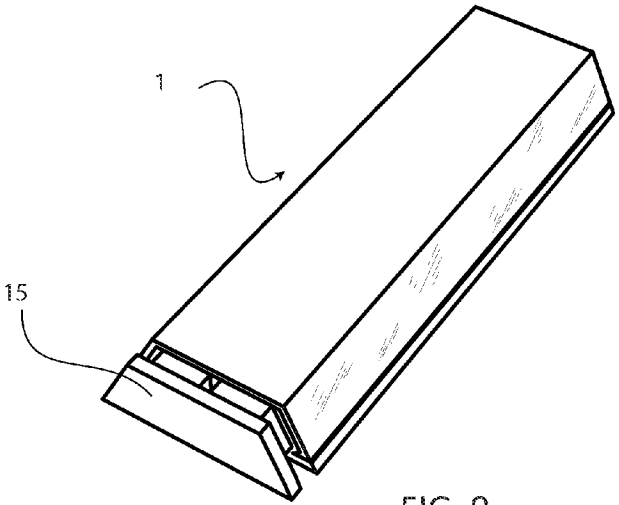
FIG. 9 is a perspective view of the one angled edge embodiment of the present invention with the at least one strip with at least one end cap engaging the at least one end opening.
Figure 8:
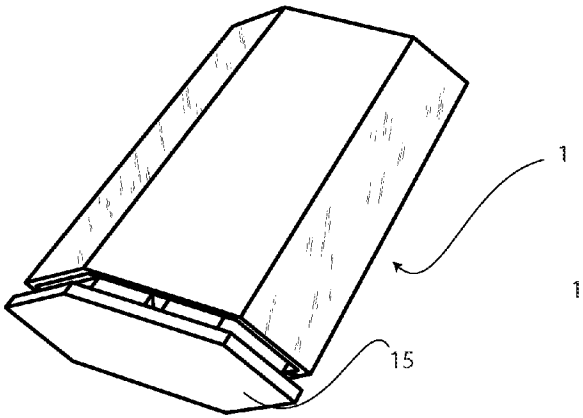
FIG. 8 is a perspective view of the doubly angled edge embodiment of the present invention with the at least one strip with at least one end cap engaging the at least one end opening.
Figure 11:
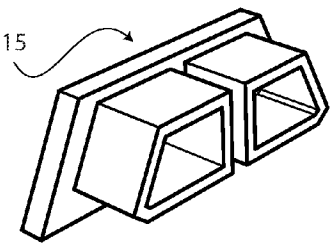
FIG. 11 is a perspective view of the at least one strip with at least one end cap for the one angled edge embodiment of the present invention.
Figure 10:
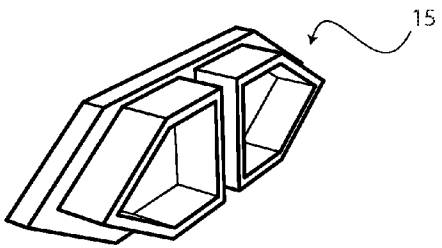
FIG. 10 is a perspective view of the at least one strip with at least one end cap for the doubly angled embodiment of the present invention.
Figure 12:
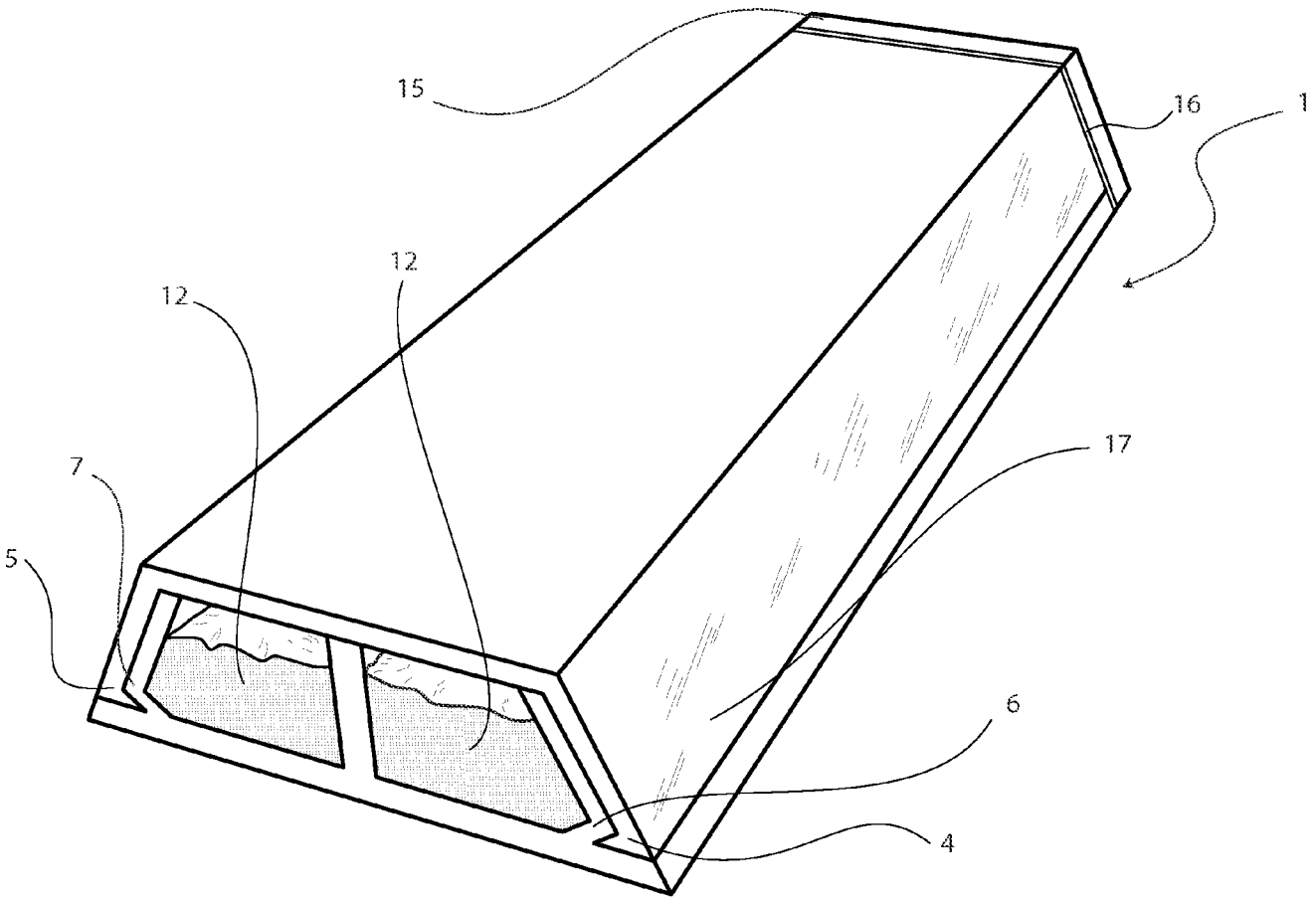
FIG. 12 is a cross sectional perspective view of the one angled edge embodiment of the present invention filled with the insulating substance.
Figure 13:
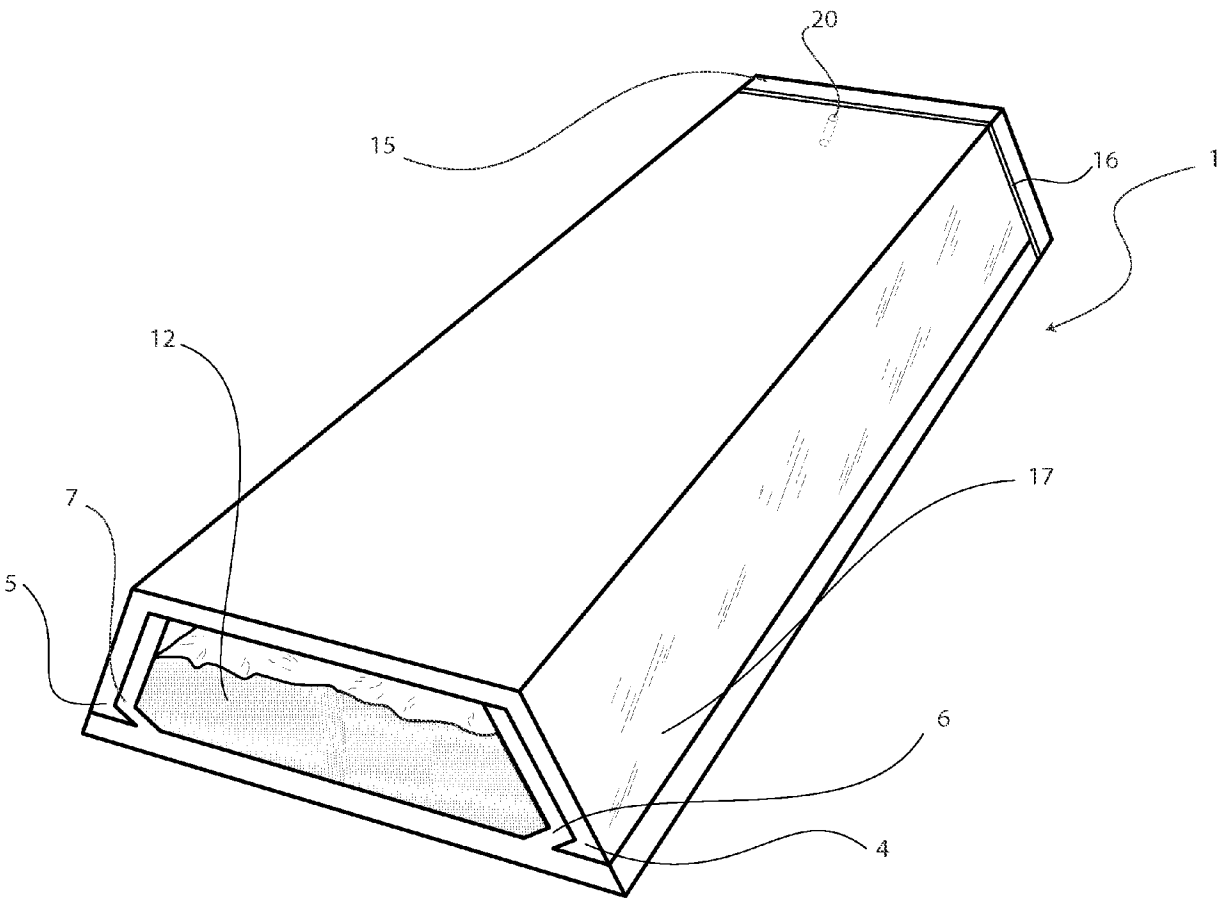
FIG. 13 is a cross sectional perspective view of the one angled edge embodiment made from the material glass filled with the insulating substance with a vent hole.

The vessels can be manufactured to any shape or design as shown in FIG. 6 and FIG. 7. When manufactured as straight segments, a plurality of the vessels can be arranged horizontally or vertically leaving areas on the glass open for seeing through. The edges of the vessels can also be manufactured according to a user's environment and preferences. For example, the sun is higher, hotter and has more damaging UV during the summer and will provide more light, heat and UV than desired, so the edges can be angled to filter the sun's rays. However, with a lower sun during the winter and a lower sun later in the day during the summer, so the angles of the edges may be made to allow the optimal amount of light in while insulating. The vessels can also be manufactured for to have the angled edge tapered towards the glass surface. This will allow for users to easily slide over the vessels while cleaning the window. By having the angled edges tapered towards the glass, it will also be beneficial as dust will not have a surface that it can easily accumulate on. For users who would like a more artistic design, the vessels can be manufactured with curves, etchings or any other shapes.

Some factors that can help users determine what configuration of vessels they would like include the following:

1. Elevation of glass and if there is any type of natural or artificial obstacle that can block the sun such as another building or a mountain.
2. Solar patterns averaged year round.
3. Geographical positions of the building and glass surfaces.
4. Average year round temperature.
5. Year round cloud coverage.
6. Direction in which the window is facing.
7. Use of the building. (Museums or offices)
8. Average hours of daylight annually and desired light.
9. User's tolerance of shadowing.
10. User's preference of tinting or coloring.
11. Curvature or angling of windows (if any).
12. Use of vessels to block visibility when desired.
13. Amount of glare the user is trying to block.
14. Amount of privacy desired by user.
15. Distance desired by user to be able to see out the window
16. Range of unobstructed vision desired by user looking (up, down, left, right).
17. The direction in which viewers will be permitted to see through.
18. Amount of poly carbonate desired for added security from outsiders breaking in.
19. Amount of polycarbonate desire for added strength to prevent breakage.

The present invention allows users to increase the insulating properties of their existing windows to minimize the heat transfer across. All of the components involved allow the user to customize the present invention to their needs depending on their environment and help in contributing to the excellent insulating properties of a existing window. In reference to FIG. 18, the Aerogel particle filled vessel are able to completely stop radiant heat from transferring through, while the films used on the present invention are able to reflect the radiant heat. Depending on the types of films used, harmful rays such as UV rays can also be filtered out while allowing the natural light through. By filtering out such harmful rays, the present invention protects the users and the objects in a room from the damaging effects that may result from exposure. Users may apply any number of the present invention of different shapes and sizes to existing windows leaving gaps of optically clear spaces for seeing through.

Figure 15:
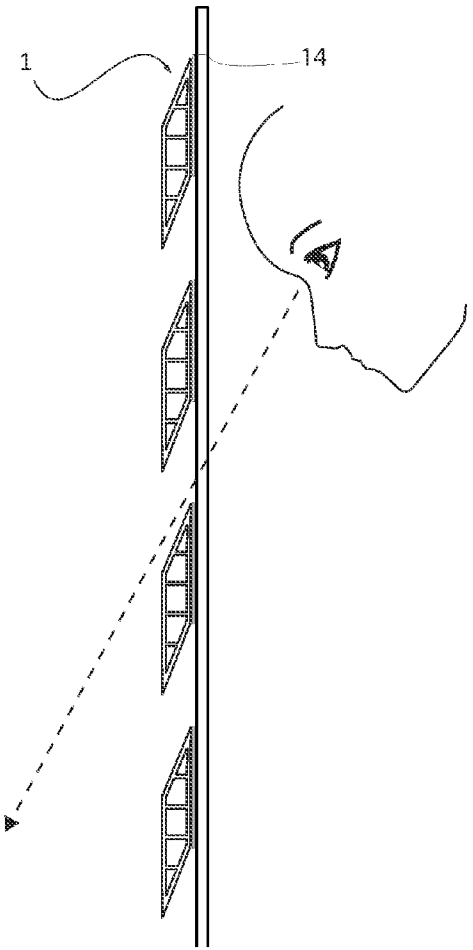
FIG. 15 shows the capabilities of the present invention to direct the vision of the user.

Users of the present invention may choose to apply the vessel on the inside surface or outside surface of the existing window. However, if the user chooses to apply the present invention to outside surface of the existing window, the vessel 1 must be made with polycarbonate material. Being on the outside surface of an existing window as shown in FIG. 15, the vessel will be exposed to the environmental forces such as rain. Due to the environmental forces, the vessels need to be made without the at least one vent holes 20 to prevent water from seeping into the interior of the vessel 1.

Figure 14:
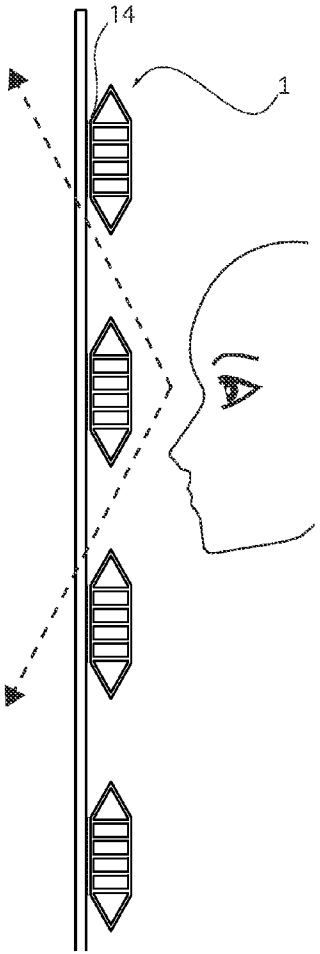
FIG. 14 shows the users large range of view even with the present invention applied to an existing window.
Figure 17:
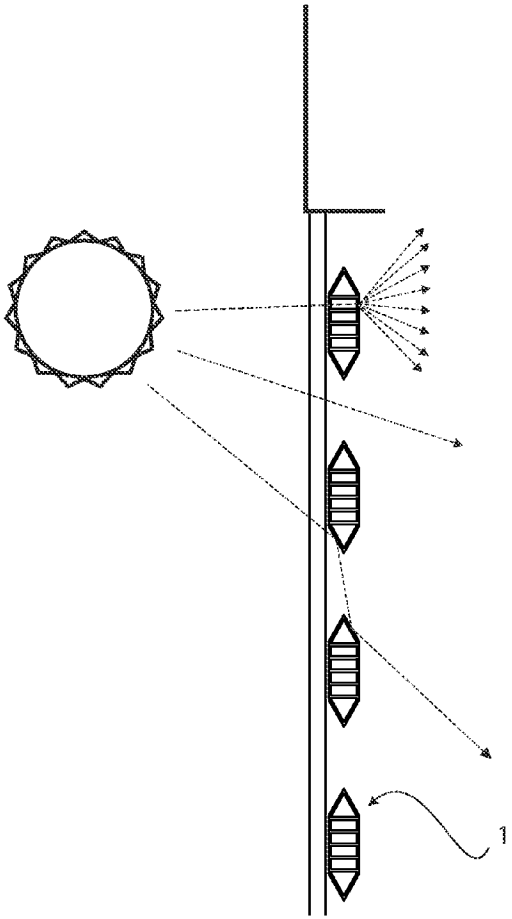
FIG. 17 shows the light distributing and light transmitting capabilities of the present invention during times with a low sun such as winter days or summer mornings and evenings. The present invention is able to allow light to disperse through the at least one vessel, reflect light in, and directly allow light through the spacing between the at least one vessels.
Figure 16:
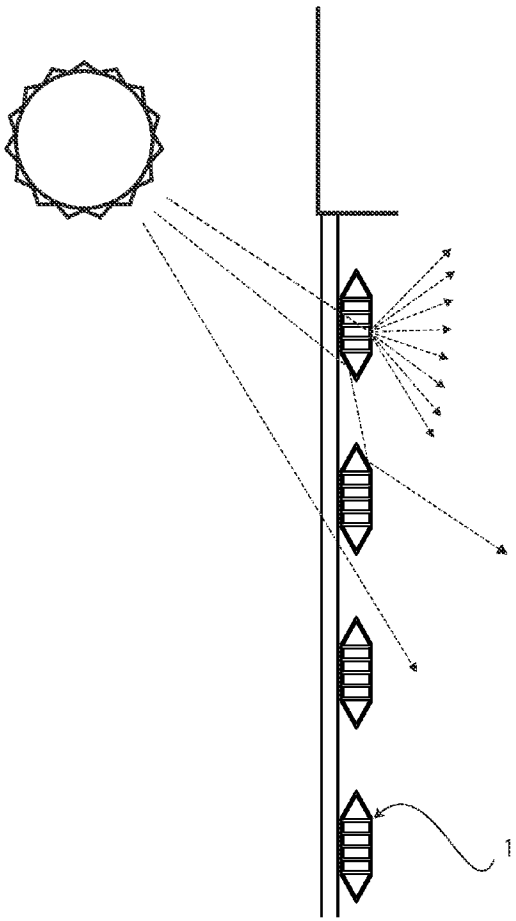
FIG. 16 shows the light distributing and light transmitting capabilities of the present invention during times with a high sun such as the summer days. The present invention is able to allow light to disperse through the at least one vessel, reflect light in, and directly allow light through the spacing between the at least one vessels.
Figure 18:
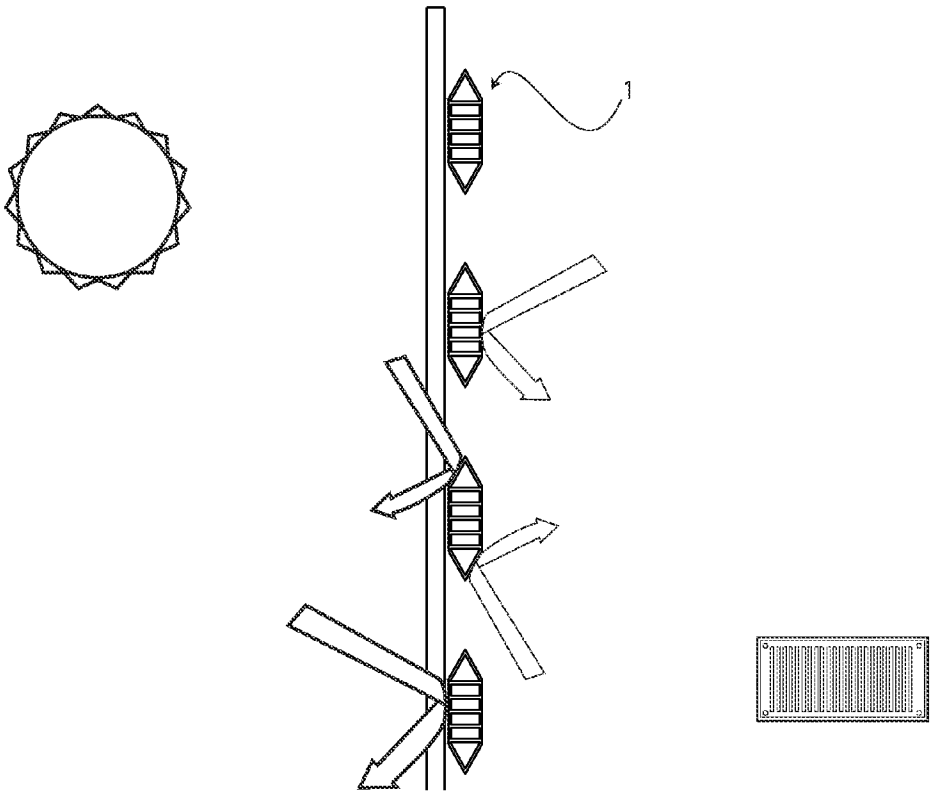
FIG. 18 shows the ability of the present invention to insulate, the arrows represent radiant heat. The present invention prevents radiant heat from travelling through the vessel.
Figure 19:
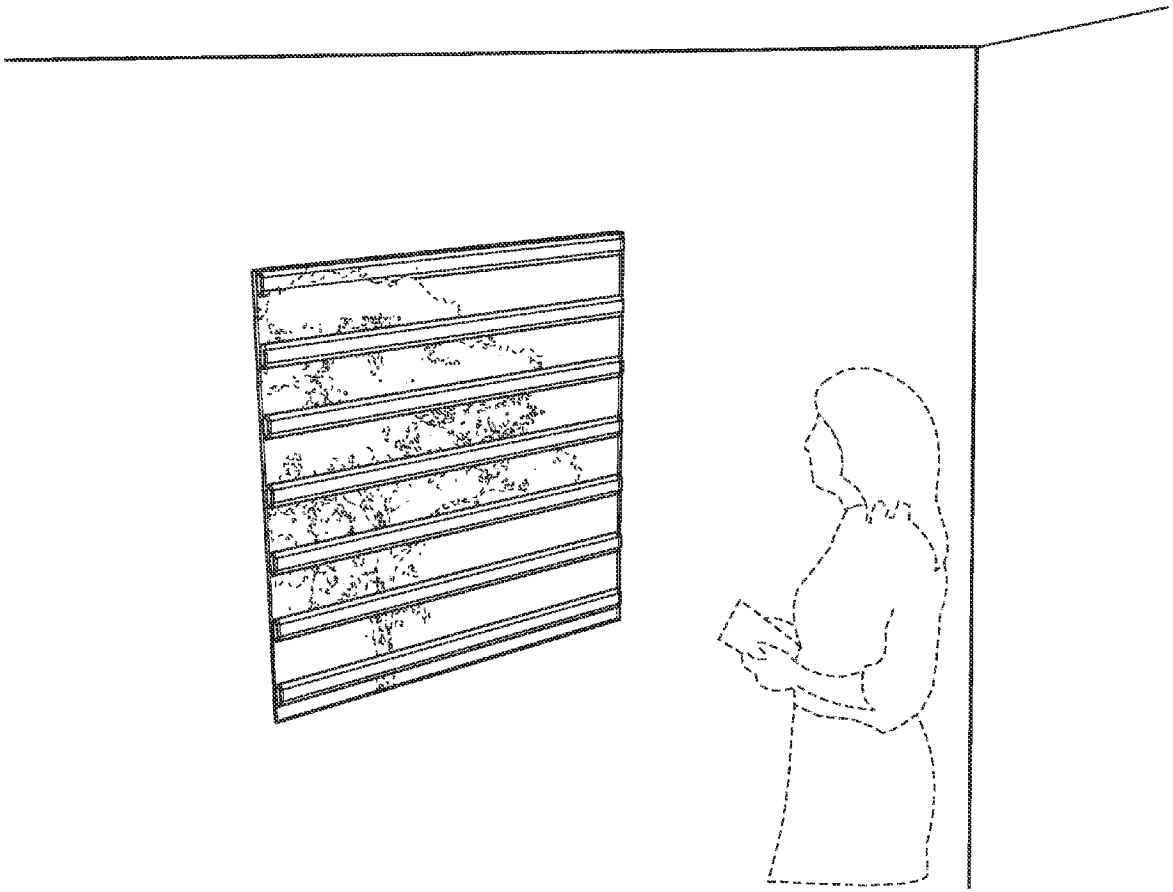
FIG. 19 show a user viewing through an existing window with the present invention applied in a horizontal pattern.

The ability of this system to control the direction that viewers can see through the system inside and outside make this system a corrective lens. A lens system is defined by a transparent optical device used to converge or disperse transmitted light to form images. Due to the ability of the present invention to diverge light into a room, the invention is a type of lens system. In reference to FIG. 14 and FIG. 15, by controlling the angling of the edges of the vessels of the system, the vessels can collectively manipulate a user's range and direction of vision. With control of a viewer's vision through the system, the present invention can also improve security of a building by limiting a viewer's ability to see into a building. For example, an existing window may extend the entire height from a floor to a ceiling, exposing an entire room or office to the outside. A vessel can be customized to completely cover the bottom portion of the existing window to block an outsider from viewing the clutter inside an office. However, it can also be short enough to allow a viewer from the inside to stand up to see out the window. There may also be instances where the view outside a window is desired to be limited. By controlling the angles of the vessels, viewers can only be allowed to see through the existing window at a limited angle. This may be desired if a view out a window may include areas which are not pleasant to view. For example, an office may be facing a view with the ocean to the left and a junkyard to the right, users of the window system may customize the vessels to be angled to block the view to the right while permitting views to the left.

Although the invention has been explained in relation to its preferred embodiment, it is to be understood that many other possible modifications and variations can be made without departing from the spirit and scope of the invention as hereinafter claimed

What is claimed is:

1. An Insulating Corrective Lens System for Window Glazing comprises, a vessel;

at least one strip with at least one end cap;

an insulating substance;

a vessel adhesive;

a vessel film;

an end cap adhesive;

at least one angled edge;

at least one angled surface;

at least one angled edge adhesive film;

at least one vent hole;

at least one end opening;

the vessel comprises of a vessel base, a vessel cover, the at least one end opening, the at least one vent hole, the at least one angled edge, and the at least one angled surface;

the vessel base comprises of a first latch receiving edge, a second latch receiving edge, at least one partition, at least one end cavity, at least one internal cavity, and at least one interior vessel adhesive film;

the at least one vent hole being a hole traversed through the vessel cover;

the at least one end opening being an open edge on at least one end of the vessel and leading into the at least one end cavity;

the at least one angled surface being an angled surface being positioned adjacent to the at least one end opening and the at least one angled edge; and the vessel cover comprises of a first edge latch and a second edge latch.

2. The Insulating Corrective Lens System for Window Glazing as claimed in claim 1 comprises, the vessel adhesive being applied to both surfaces of the vessel film;

the vessel film being adhered to the vessel by means of the vessel adhesive;

the at least one internal cavity and the at least one external cavity being defined by the at least one partition;

the at least one interior vessel adhesive film being adhered to the at least one partition;

the vessel cover being attached to the vessel base by the first edge latch and second edge latch being engaged to the first latch receiving edge and second latch receiving edge, respectively;

the at least one vent hole being positioned on the vessel cover leading into the at least one end cavity and at least one internal cavity;

the at least one end opening leading to the at least one end cavity; and the at least one end cavity and at least one internal cavity being filled with the insulating substance.

3. The Insulating Corrective Lens System for Window Glazing as claimed in claim 1 comprises, the at least one strip with at least one end cap being connected to the at least one end opening of the vessel by means of the end cap adhesive.

4. The Insulating Corrective Lens System for Window Glazing as claimed in claim 1 comprises, the at least one angled edge being positioned on sides and ends of the vessel;

the at least one angled surface being positioned on the at least one angled edge; and the at least one angled edge adhesive film being adhered to the at least one angled surface.

5. The Insulating Corrective Lens System for Window Glazing as claimed in claim 2 comprises, the vessel base is made of an optically clear and UV stable material selected from the group consisting of polycarbonate, glass, and acrylic;

the vessel cover is made of an optically clear and UV stable material selected from the group consisting of polycarbonate, glass, and acrylic;

the at least one interior vessel adhesive film is made of an optically clear pressure sensitive adhesive film selected from the group consisting of Biaxially-oriented polyethylene terephthalate film, reflective film, sputtered film, polyester film, ceramic film, and tinted film;

the vessel adhesive uses optically clear adhesive means selected from the group consisting of pressure sensitive adhesives, solvent based adhesives and water activated adhesives;

the vessel film is made of an optically clear film selected from the group consisting of Biaxially-oriented polyethylene terephthalate film, reflective film, sputtered film, polyester film, ceramic film, and tinted film; and the insulating substance is made of translucent materials selected from the group consisting of translucent Nanogel, Aerogel, and Maerogel.

6. The Insulating Corrective Lens System for Window Glazing as claimed in claim 3 comprises, the at least one strip with at least one end cap is made of an optically clear and UV stable material selected from the group consisting of polycarbonate, glass, and acrylic; and the end cap adhesive is made of an optically clear and UV stable adhesive selected from the group consisting of silicone resin, gasketing resin, modified acrylated resin, and epoxy resin.

7. The Insulating Corrective Lens System for Window Glazing as claimed in claim 3 comprises, the at least one angled edge can be angled depending on environments to be configured to allow more or less light through, and/or increase or decrease degree of transparency for viewing through, and/or the controlling of vision through any clear glazing not obscured by the insulating substance in the at least one vessel, and/or arranged to completely block vision through a window; and the at least one angled edge adhesive film is made of a optically clear film selected from the group consisting of Biaxially-oriented polyethylene terephthalate film, reflective film, sputtered film, polyester film, ceramic film, and tinted film.

8. An Insulating Corrective Lens System for Window Glazing comprises, a vessel;

at least one strip with at least one end cap;

an insulating substance;

a vessel adhesive;

a vessel film;

an end cap adhesive;

at least one angled edge;

at least one angled surface;

at least one angled edge adhesive film;

at least one vent hole;

at least one end opening;

the vessel comprises of a vessel base, a vessel cover, the at least one end opening, the at least one vent hole, the at least one angled edge, and the at least one angled surface;

the vessel base comprises of a first latch receiving edge, a second latch receiving edge, at least one partition, at least one end cavity, at least one internal cavity, and at least one interior vessel adhesive film;

the at least one vent hole being a hole traversed through the vessel cover;

the at least one end opening being an open edge on at least one end of the vessel and leading into the at least one end cavity;

the at least one angled surface being an angled surface being positioned adjacent to the at least one end opening and the at least one angled edge;

the vessel cover comprises of a first edge latch and a second edge latch;

the vessel adhesive being applied to both surfaces of the vessel film;

the vessel film being adhered to the vessel by means of the vessel adhesive;

the at least one internal cavity and the at least one external cavity being defined by the at least one partition; and the at least one interior vessel adhesive film being adhered to the at least one partition.

9. The Insulating Corrective Lens System for Window Glazing as claimed in claim 8 comprises, the vessel cover being attached to the vessel base by the first edge latch and second edge latch being engaged to the first latch receiving edge and second latch receiving edge, respectively;

the at least one vent hole being positioned on the vessel cover leading into the at least one end cavity and at least one internal cavity;

the at least one end opening leading to the at least one end cavity; and the at least one end cavity and at least one internal cavity being filled with the insulating substance.

10. The Insulating Corrective Lens System for Window Glazing as claimed in claim 8 comprises, the at least one strip with at least one end cap being connected to the at least one end opening by means of the end cap adhesive.

11. The Insulating Corrective Lens System for Window Glazing as claimed in claim 8 comprises, the at least one angled edge being positioned on sides and ends of the vessel;

the at least one angled surface being positioned on the at least one angled edge; and the at least one angled edge adhesive film being adhered to the at least one angled surface.

12. The Insulating Corrective Lens System for Window Glazing as claimed in claim 9 comprises, the vessel base is made of an optically clear and UV stable material selected from the group consisting of polycarbonate, glass, and acrylic;

the vessel cover is made of an optically clear and UV stable material selected from the group consisting of polycarbonate, glass, and acrylic;

the at least one interior vessel adhesive film is made of an optically clear pressure sensitive adhesive film selected from the group consisting of Biaxially-oriented polyethylene terephthalate film, reflective film, sputtered film, polyester film, ceramic film, and tinted film;

the vessel adhesive uses optically clear adhesive means selected from the group consisting of pressure sensitive adhesives, solvent based adhesives and water activated adhesives;

the vessel film is made of an optically clear film selected from the group consisting of Biaxially-oriented polyethylene terephthalate film, reflective film, sputtered film, polyester film, ceramic film, and tinted film; and the insulating substance is made of translucent materials selected from the group consisting of translucent Nanogel, Aerogel, and Maerogel.

13. The Insulating Corrective Lens System for Window Glazing as claimed in claim 10 comprises, the at least one strip with at least one end cap is made of an optically clear and UV stable material selected from the group consisting of polycarbonate, glass, and acrylic; and the end cap adhesive is made of an optically clear and UV stable adhesive selected from the group consisting of silicone resin, gasketing resin, modified acrylated resin, and epoxy resin.

14. The Insulating Corrective Lens System for Window Glazing as claimed in claim 11 comprises, the at least one angled edge can be angled depending on environments to be configured to allow more or less light through, and/or increase or decrease degree of transparency for viewing through, and/or the controlling of vision through any clear glazing not obscured by the insulating substance in the at least one vessel, and/or arranged to completely block vision through a window; and the at least one angled edge adhesive film is made of an optically clear film selected from the group consisting of Biaxially-oriented polyethylene terephthalate film, reflective film, sputtered film, polyester film, ceramic film, and tinted film.

15. An Insulating Corrective Lens System for Window Glazing comprises, a vessel;

at least one strip with at least one end cap;

an insulating substance;

a vessel adhesive;

a vessel film;

an end cap adhesive;

at least one angled edge;

at least one angled surface;

at least one angled edge adhesive film;

at least one vent hole;

at least one end opening;

the vessel comprises of a vessel base, a vessel cover, the at least one end opening, the at least one vent hole, the at least one angled edge, and the at least one angled surface;

the vessel base comprises of a first latch receiving edge, a second latch receiving edge, at least one partition, at least one end cavity, at least one internal cavity, and at least one interior vessel adhesive film;

the at least one vent hole being a hole traversed through the vessel cover;

the at least one end opening being an open edge on at least one end of the vessel and leading into the at least one end cavity;

the at least one angled surface being an angled surface being positioned adjacent to the at least one end opening and the at least one angled edge;

the vessel cover comprises of a first edge latch and a second edge latch;

the vessel adhesive being applied to both surfaces of the vessel film;

the vessel film being adhered to the vessel by means of the vessel adhesive;

the at least one internal cavity and the at least one external cavity being defined by the at least one partition;

the at least one interior vessel adhesive film being adhered to the at least one partition;

the at least one angled edge being positioned on sides and ends of the vessel;

the at least one angled surface being positioned on the at least one angled edge; and the at least one angled edge adhesive film being adhered to the at least one angled surface.

16. The Insulating Corrective Lens System for Window Glazing as claimed in claim 15 comprises, the vessel cover being attached to the vessel base by the first edge latch and second edge latch being engaged to the first latch receiving edge and second latch receiving edge, respectively;

the at least one vent hole being positioned on the vessel cover leading into the at least one end cavity and at least one internal cavity;

the at least one end opening leading to the at least one end cavity; and the at least one end cavity and at least one internal cavity being filled with the insulating substance.

17. The Insulating Corrective Lens System for Window Glazing as claimed in claim 15 comprises, the at least one strip with at least one end cap being connected to the at least one end opening by means of the end cap adhesive.

18. The Insulating Corrective Lens System for Window Glazing as claimed in claim 15 comprises, the at least one angled edge can be angled depending on environments to be configured to allow more or less light through, and/or increase or decrease degree of transparency for viewing through, and/or the controlling of vision through any clear glazing not obscured by the insulating substance in the at least one vessel, and/or arranged to completely block vision through a window; and the at least one angled edge adhesive film is made of an optically clear film selected from the group consisting of Biaxially-oriented polyethylene terephthalate film, reflective film, sputtered film, polyester film, ceramic film, and tinted film.

19. The Insulating Corrective Lens System for Window Glazing as claimed in claim 16 comprises, the vessel base is made of an optically clear and UV stable material selected from the group consisting of polycarbonate, glass, and acrylic;

the vessel cover is made of an optically clear and UV stable material selected from the group consisting of polycarbonate, glass, and acrylic;

the at least one interior vessel adhesive film is made of an optically clear pressure sensitive adhesive film selected from the group consisting of Biaxially-oriented polyethylene terephthalate film, reflective film, sputtered film, polyester film, ceramic film, and tinted film;

the vessel adhesive uses optically clear adhesive means selected from the group consisting of pressure sensitive adhesives, solvent based adhesives and water activated adhesives;

the vessel film is made of an optically clear film selected from the group consisting of Biaxially-oriented polyethylene terephthalate film, reflective film, sputtered film, polyester film, ceramic film, and tinted film; and the insulating substance is made of translucent materials selected from the group consisting of translucent Nanogel, Aerogel, and Maerogel.

20. The Insulating Corrective Lens System for Window Glazing as claimed in claim 17 comprises, the at least one strip with at least one end cap is made of an optically clear and UV stable material selected from the group consisting of polycarbonate, glass, and acrylic; and the end cap adhesive is made of an optically clear and UV stable adhesive selected from the group consisting of silicone resin, gasketing resin, modified acrylated resin, and epoxy resin.

* * * * *